US007522104B2

(12) United States Patent
Sugiyama

(10) Patent No.: US 7,522,104 B2
(45) Date of Patent: Apr. 21, 2009

(54) ANTENNA AND WIRELESS APPARATUS

(75) Inventor: Yuuichi Sugiyama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 168 days.

(21) Appl. No.: 11/475,002

(22) Filed: Jun. 27, 2006

(65) Prior Publication Data

US 2007/0222688 A1 Sep. 27, 2007

(30) Foreign Application Priority Data

Mar. 27, 2006 (JP) ..... 2006-085075

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 725, 873
See application file for complete search history.

(56) References Cited

U.S. PATENT DOCUMENTS 5,767,810 A 6/1998 Hagiwara et al.
6,268,831 B1 * 7/2001 Sanford ..... 343/702
6,781,553 B2 8/2004 Iguchi et al.
6,995,714 B2 * 2/2006 Sim et al. ..... 343/702
7,034,754 B2 * 4/2006 Hung et al. ..... 343/700 MS
7,119,747 B2 * 10/2006 Lin et al. ..... 343/702
2006/0017621 A1 1/2006 Okawara et al.

FOREIGN PATENT DOCUMENTS

JP 2004-266311 9/2004
WO WO 96/34426 A1 10/1996
WO WO 02/13312 A1 2/2002

* cited by examiner

*Primary Examiner*—Shih-Chao Chen
(74) *Attorney, Agent, or Firm*—Kratz, Quintos & Hanson, LLP.

(57) ABSTRACT

An antenna that provides three resonance frequencies includes a dielectric, and an electrically conductive antenna element arranged on a dielectric, the antenna element branches into three parts and being connected to a single feeding point, and at least two of the three parts being electromagnetically coupled with each other.

7 Claims, 11 Drawing Sheets

ANTENNA AND WIRELESS APPARATUS

This application claims the right of foreign priority under 35 U.S.C. §119 based on Japanese Patent Application No. 2006-085075, filed on Mar. 27, 2006, which is hereby incorporated by reference herein in its entirety as if fully set forth herein.

BACKGROUND OF THE INVENTION

The present invention relates generally to an antenna used for a wireless apparatus, and more particularly to an antenna that provides three or more resonance frequencies, and a wireless apparatus having the antenna. The present invention is suitable, for example, for a triple band antenna installed in a cellular phone such as a personal digital cellular ("PDC"), a personal handy phone system ("PHS"), and another mobile communication terminal, which are generally referred to as "mobile radio communication apparatuses."

Along with the recent widespread of the mobile radio communication apparatuses, the cellular phone is increasingly required for expanded communication services and further miniaturization. The conventional cellular phone provides services in one or more resonance frequency bands, such as 2 GHz band and 800 MHz band.

Use of a built-in antenna corresponding to each band is necessary to provide communication services in two or more resonance frequency bands, i.e., multi-band services. In that case, use of two or more resonance antennas or single band antennas for the cellular phone, each of which provides one resonance frequency band or a single band, would scarify the miniaturization. Accordingly, a resonance antenna that provides two resonance frequency bands (called a dual band antenna) is proposed.

Prior art include, for example, PCT International Publications Nos. 96/34426 and 02/13312, and Japanese Patent Application, Publication No. 2004-266311.

The cellular phones will be likely to expand the number of resonance frequencies for communication services in the near future, such as an additional 1.7 GHz band, but no triple band antenna that provides three resonance frequencies (triple band) has yet been proposed. Currently, the triple band needs to use three single band antennas or a combination of one dual band antenna and one single band antenna. As discussed above, use of plural antennas hinders the miniaturization of the cellular phone.

BRIEF SUMMARY OF THE INVENTION

Accordingly, it is an exemplified object of the present invention to provide an antenna that maintains the miniaturization and provides three or more resonance frequencies, a control method of a resonance frequency using the same, and a wireless apparatus having the same.

An antenna according to one aspect of the present invention that provides three resonance frequencies includes a dielectric, and an electrically conductive antenna element arranged on a dielectric, the antenna element branches into three parts and being connected to a single feeding point, and at least two of the three parts being electromagnetically coupled with each other. Usually, merely branched three parts of the antenna element provide only two resonance frequencies. The instant inventors discover that electromagnetic coupling of at least two antenna element parts would provide three resonance frequencies. As a result, this antenna serves as a triple band resonance antenna. A single antenna provides the triple band, promoting the space saving effect rather than use of plural antennas and the miniaturization of the wireless apparatus. For electromagnetic coupling, the at least two are arranged close to each other, for example, within an interval of 1 mm. Whether there is electromagnetic coupling can be determined, for example, based on whether a relationship between the return loss and the frequency changes when an interval between the two antenna element parts is varied.

The antenna element may have a solid or three-dimensional structure by bending an electric conductor on the dielectric. The solid structure can provide the electromagnetic coupling while maintaining the miniaturization of the antenna. For example, the solid structure one of the at least two, and bends the other so as to enclose the one.

The three parts may include a first part that extends in a first direction and has a Z shape, a second part that extends in a second direction opposite to the first direction and has, for example, a J shape, and a third part that extends in the second direction and then bends in a third direction perpendicular to the second direction and has, for example, an S shape, wherein the solid structure bends the first part in the second direction, bends the second part in the first direction, and bends the third part so as to enclose the second part that has been bent, and wherein the second part that has been bent is electromagnetically coupled with the third part that has been bent. The shapes of the first, second and third parts are not limited to the Z, J and S shape, but these shapes can provide a small antenna suitable for a cellular phone for 800 MHz, 2 GHz, and 1.7 GHz.

A method according to another aspect of the present invention for controlling plural resonance frequencies of an antenna that arranges, on a dielectric, an electrically conductive antenna element that branches into plural parts includes the steps of connecting the antenna element to a single feeding point, and electromagnetically coupling two of the plural parts and adjusting the interval between the two. While the resonance frequency depends upon the material of the dielectric and the length of the antenna element, the instant inventors have discovered that the resonance frequency also depends upon the interval between the two electromagnetically coupled antenna element parts. Therefore, a fine adjustment of the resonance frequency is available when the interval is adjusted. For example, the plural parts are three parts, and the plural resonance frequencies are three resonance frequencies.

A wireless apparatus that includes the above antenna, such as a mobile radio communication apparatus, can provide communications at three or more resonance frequencies while maintaining the miniaturization using the multifunctional antenna.

Other objects and further features of the present invention will become readily apparent from the following description of preferred embodiments with reference to the accompanying drawings.

DETAILED DESCRIPTION OF THE PREFERRED EMBODIMENTS

Figure 1A:
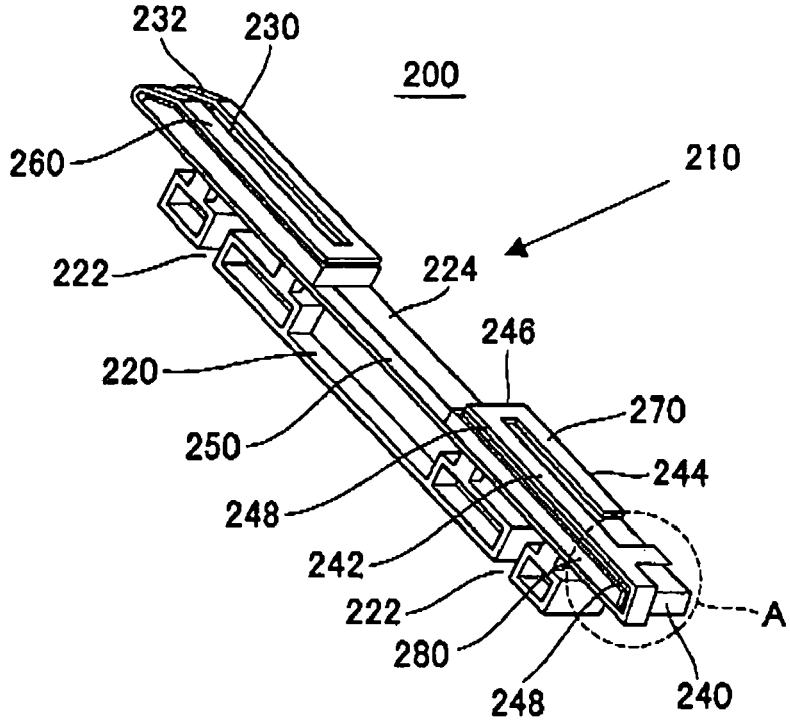
FIGS. 1A is an enlarged perspective view of an antenna viewed from the lower side according to one embodiment of the present invention.
Figure 1B:
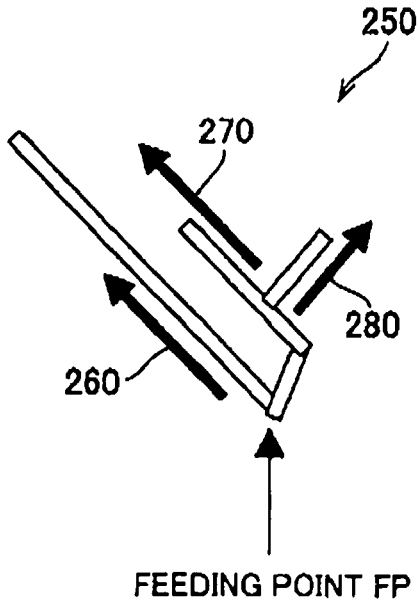
FIG. 1B is an enlarged perspective view of an A part in FIG. 1A.
Figure 2:
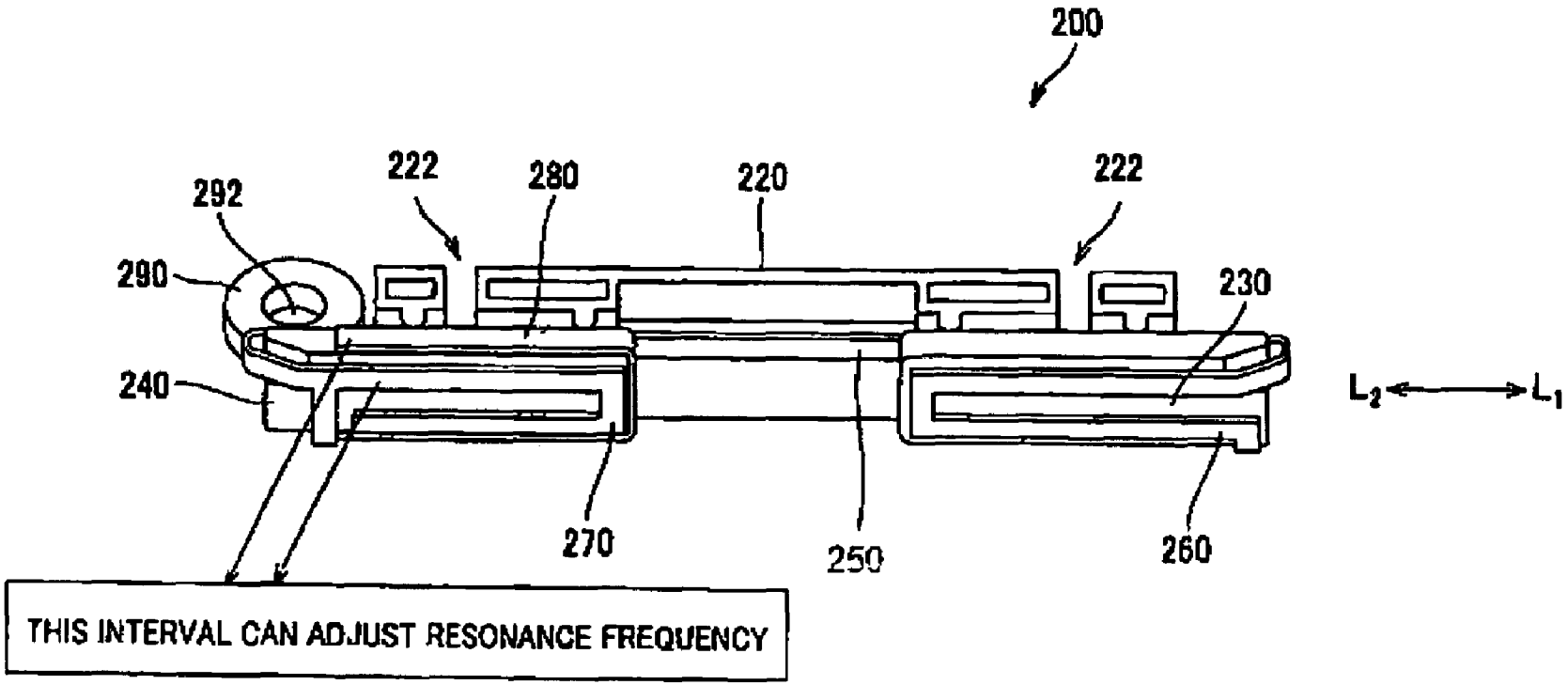
FIG. 2 is an enlarged perspective view of the antenna shown in FIG. 1A viewed from the upper side.

Referring now to the accompanying drawings, a description will be given of an antenna according to one embodiment of the present invention. The antenna of this embodiment serves as a triple band antenna. Here, FIG. 1A is an enlarged perspective view of a triple band antenna 200 viewed from the lower side. FIG. 1B is an enlarged perspective view of an A part in FIG. 1A. FIG. 2 is an enlarged perspective view of the triple antenna 200 viewed from the upper side. The triple antenna 200 includes, as shown in FIG. 1A, a dielectric 210, an antenna element 250, and a fixture part 290 (which is omitted in FIG. 1A but shown in FIG. 2).

The dielectric 210 supports the antenna element 250 and its material is one determinant of the resonance frequency provided by the antenna 200. The dielectric 210 defines the contour of the antenna 210. The dielectric 210 has a base 220, a first support pedestal 230, and a second support pedestal 240, each of which has an approximately rectangular parallelepiped shape. In FIG. 1A, the first support pedestal 230 is provided at the left side of the base 220, and the second support pedestal 240 is provided at the right side of the base 220.

The base 220 has a pair of engagement holes 222 to be engaged with a pair of projections of a movable radio communication apparatus 100, and has a top surface 224 to which a first antenna element part 260 is partially adhered.

The first support pedestal 230 projects by its about one-third length from the left side of the base 220 shown in FIG. 1A, and fixed onto the base 220 at its bottom portion. There is an aperture between the first support pedestal 230 and the base 220, and the first antenna element part 260 passes through the aperture. The first support pedestal 230 has an approximately rectangular parallelepiped shape, and is chamfered at the top end that projects from the left side of the base 220 shown in FIG. 1A. The first support pedestal 230 is entangled with the first antenna element part 260. The first antenna element part 260 is supported on and adhered to a top surface 232 of the first support pedestal 230.

The second support pedestal 240 projects by its about one-third length from the right side of the base 220 shown in FIG. 1A, and fixed onto the base 220 at its bottom portion. There is an aperture between the second support pedestal 240 and the base 220, and the first antenna element part 260 passes through the aperture. The second support pedestal 240 has an approximately rectangular parallelepiped shape, and is chamfered at the top end that projects from the right side of the base 220 shown in FIG. 1A. The second support pedestal 240 is entangled with second and third antenna element parts 270 and 280. The second and third antenna element parts 270 and 280 are partially supported on and adhered to a top surface 232 of the second support pedestal 240. The third antenna element part 280 is then entangled around a side surface 244 at the back side perpendicular to the top surface 242, a left side surface 246, and a side surface 248 at the front side in FIG. 1A.

Figure 3:
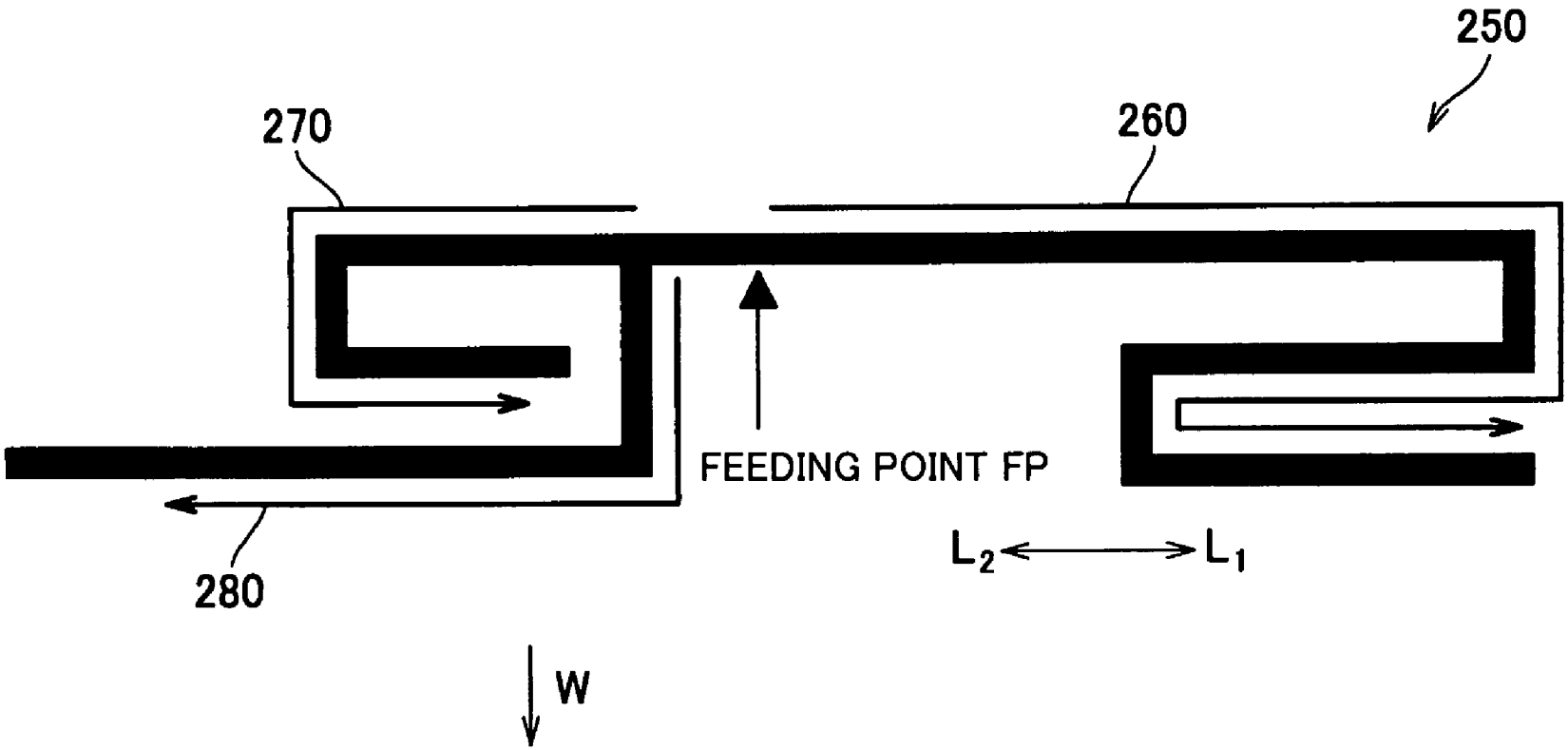
FIG. 3 is a developed plane view of the antenna shown in FIG. 1A.

FIG. 3 is a developed plane view of the antenna element 250. The antenna element 250 is a strip member made of an electrically conductive material, such as copper, fixed on the dielectric 210, and provides three resonance frequencies. The antenna elements branches, as shown in FIG. 3, into a first antenna element part 260, a second antenna element part 270, and a third antenna element part 280. An A part in FIG. 1A shows the branching portion. The first to third antenna elements 260 to 280 are physically coupled to each other. The first to third antenna element parts 260 to 280 are connected to a single feeding point FP, and generate a parallel resonance mode.

In this embodiment, the first antenna element part 260 generates a resonance frequency of 800 MHz, the second antenna element part 270 generates a resonance frequency of 1.7 GHz, and the third antenna element part 280 generates a resonance frequency of 2 GHz. The lengths of the first to third antenna element parts 260 to 280 are determinants to determine the resonance frequency. In this embodiment, the first antenna element part 260 is the longest part, and second antenna element part 270 is a second longest part, and the third antenna element part 280 is the shortest part.

As shown in FIG. 3, the first antenna element part 260 extends in $L_1$ direction viewed from the feeding point FP, the second antenna element part 270 extends in $L_2$ direction viewed from the feeding point FP, and the third antenna element part 280 extends in the $L_2$ direction and then bends in a W direction perpendicular to the $L_2$ direction viewed from the feeding point FP.

In FIG. 3, the first antenna element part 260 has a Z shape, the second antenna element part 270 has a J shape, and the third antenna element part 270 has an S shape. This embodiment does not limit the shapes of the first to third antenna element parts 260 to 280 to Z, J and S shapes. Therefore, if the space permits, the first antenna element part 260 may be formed, for example, as a straight line shape. However, bending these shapes as shown in FIG. 1A can realize a small antenna suitable particularly for the cellular phone for 800 MHz, 2 GHz and 1.7 GHz bands.

The antenna element 250 has a solid or three-dimensional shape, thereby realizing electromagnetic coupling and miniaturization, as will be described later. Referring to FIG. 2, this solid structure bends the first antenna element part 260 in the $L_2$ direction, and the second antenna element part 270 in the $L_1$ direction. The third antenna element part 270 is bent along the side surfaces 244 to 248 after once bent on the top surface 242 shown in FIG. 1A so as to enclose the second antenna element part 270.

This embodiment electromagnetically couples the second antenna element part 270 to the third antenna element part 280. More specifically, the bent second antenna element part 270 is electromagnetically coupled with the bent third antenna element part 280. Usually, merely branched three parts of the antenna element provide only two resonance frequencies. The instant inventors discover that electromagnetic coupling of at least two antenna element parts would provide three resonance frequencies.

Figure 4A:
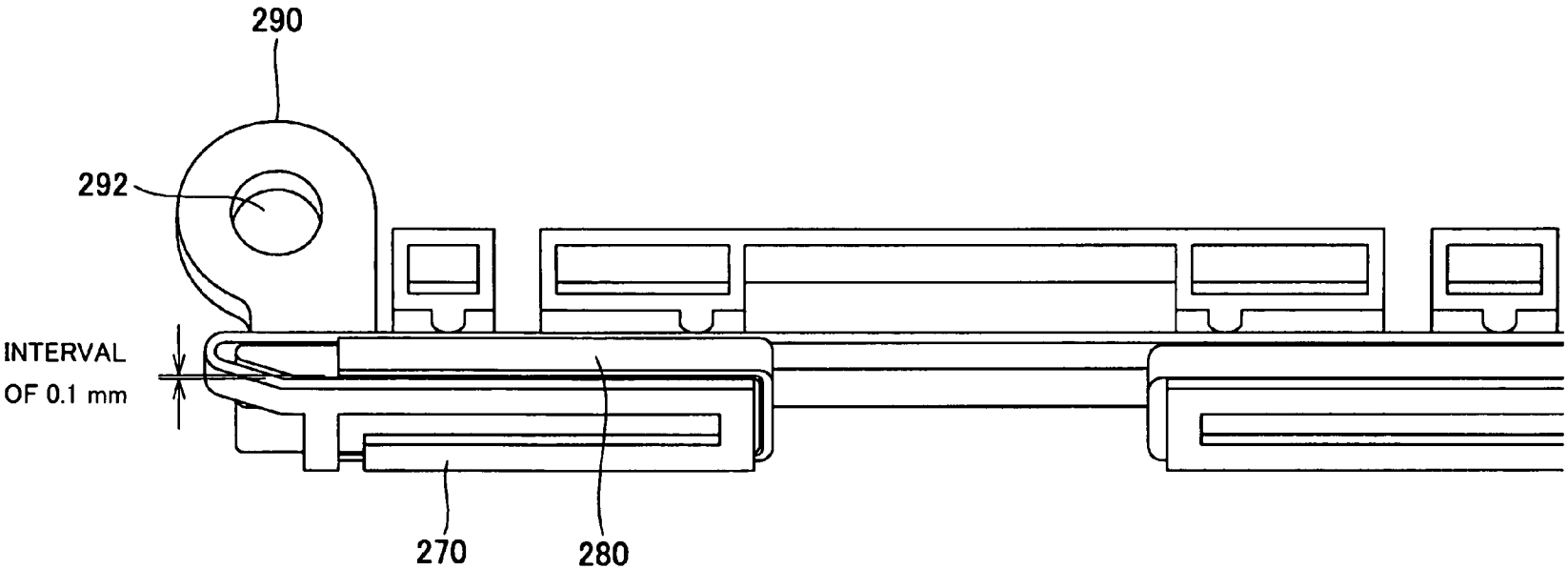
FIG. 4A is a partially enlarged perspective view when an interval between second and third antenna element parts shown in FIGS. 1A and 2 is set to 0.1 mm.
Figure 4B:
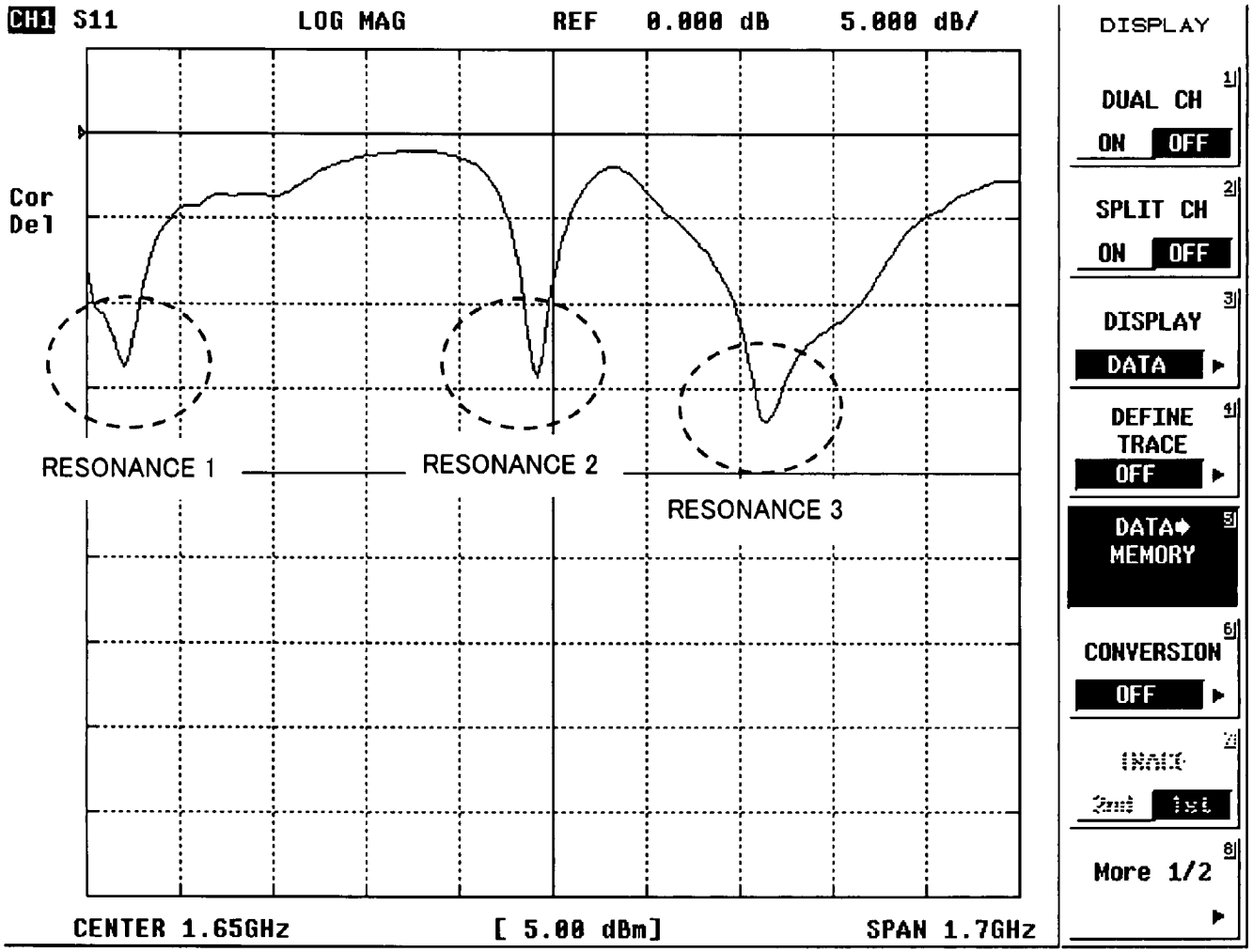
FIG. 4B is a graph showing a relationship between the return loss and the frequencies in that case.
Figure 5A:
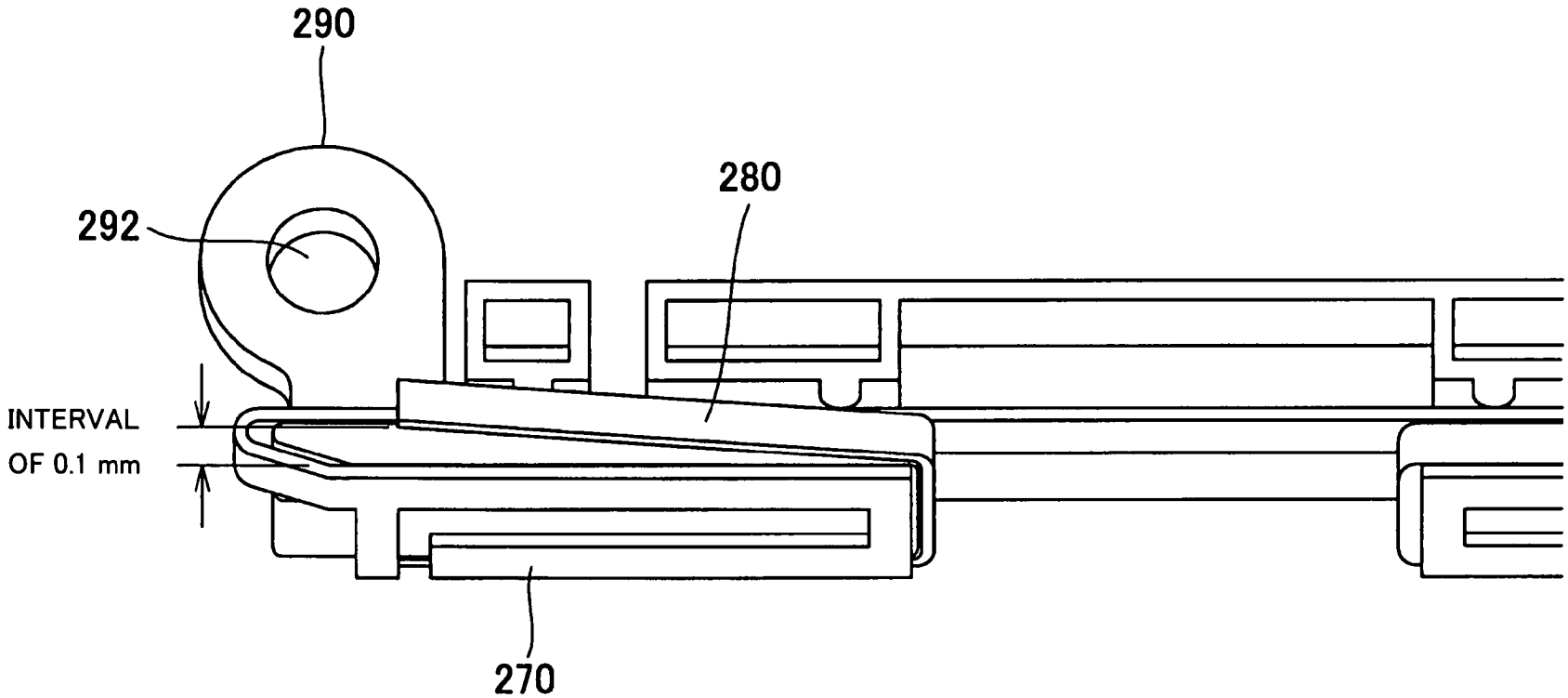
FIG. 5A is a partially enlarged perspective view when an interval between second and third antenna element parts shown in FIGS. 1A and 2 is set to 1.0 mm.
Figure 5B:
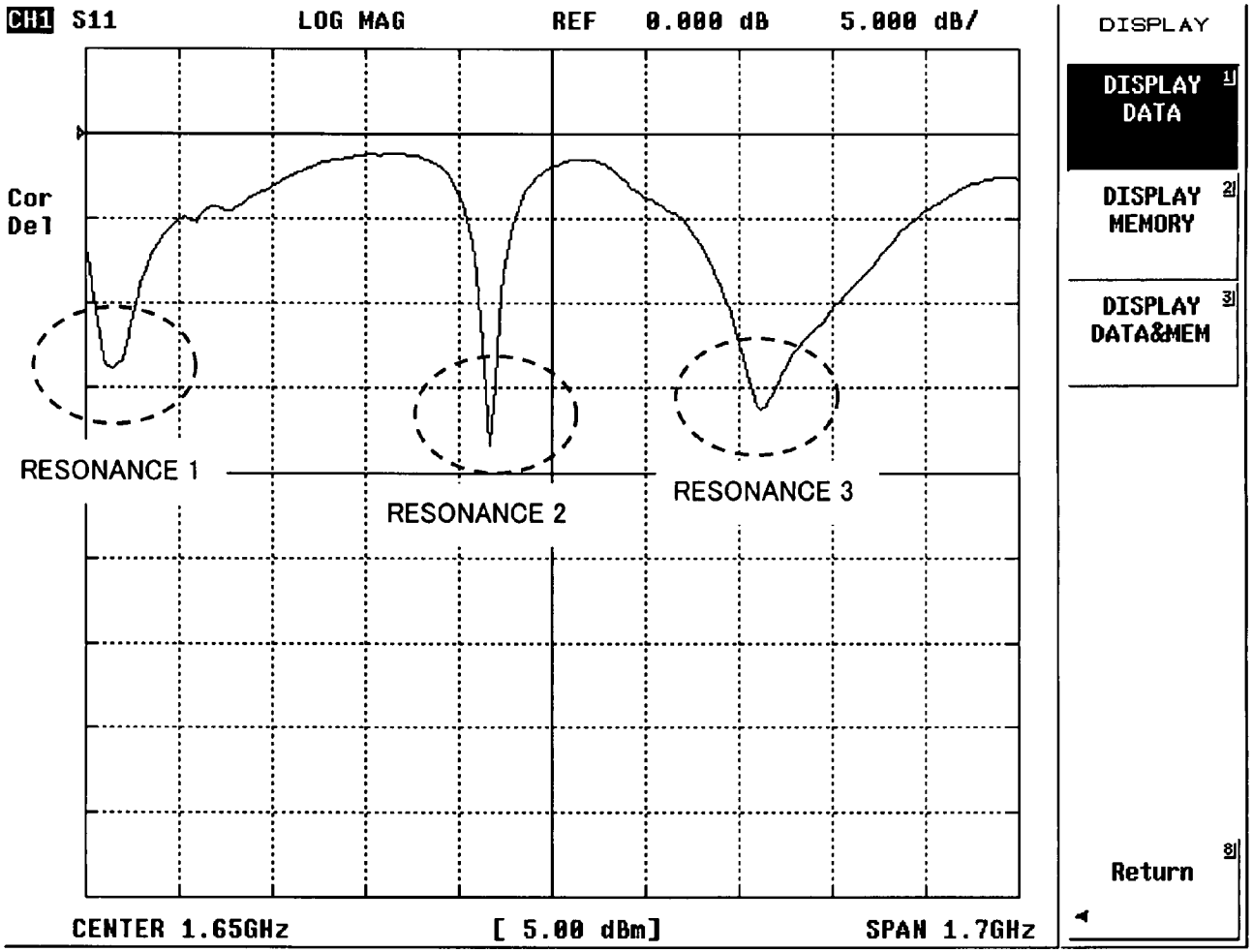
FIG. 5B is a graph showing a relationship between the return loss and the frequencies in that case.

FIG. 4A is a partially enlarged perspective view of an electromagnetic coupling structure when the interval between the second antenna element part 270 and the third antenna element part 280 is set to 0.1 mm. FIG. 4B is a graph showing a relationship between the return loss (ordinate axis) and the frequency (abscissa axis) at that time. FIG. 5A is a partially enlarged perspective view of an electromagnetic coupling structure when the interval between the second antenna element part 270 and the third antenna element part 280 is set to 1.0 mm. FIG. 5B is a graph showing a relationship between the return loss (ordinate axis) and the frequency (abscissa axis) at that time.

Drops in FIGS. 4B and 5B represent the resonance frequencies, and it is understood that three resonance frequencies appear. As a result, the antenna 200 serves as a triple band antenna. A single antenna realizes the triple band, and promotes the space saving rather than use of plural antennas, thereby miniaturizing the radio mobile communication apparatus 100, which will be described later.

In FIGS. 4B and 5B, Resonance 1 corresponds to the resonance frequency of 800 MHz. Resonance 2 corresponds to the resonance frequency of 1.75 GHz. Resonance 3 corresponds to the resonance frequency of 2 GHz. It is understood from FIGS. 4B and 5B that the second frequency is variable when the interval is adjusted between the second antenna element part 270 and the third antenna element part 280.

For electromagnetic coupling, two antenna element parts are arranged close to each other, for example, within an interval of 1 mm. Whether there is electromagnetic coupling can be determined, for example, based on whether a relationship between the return loss and the frequency changes as an interval between the two antenna element parts is varied. In FIGS. 4A and 5A, the first antenna element part 260 is not electrically coupled with the second antenna element part 270 or the third antenna element part 280. This is understood from that fact that Resonances 1 and 3 do not change even when the interval is adjusted in FIGS. 4B and 5B. However, the present invention does not limit the electromagnetic coupling pair to the second and third antenna element parts 270 and 280, and it is sufficient that there is electromagnetic coupling between at least two of the three branches. This embodiment adds 1.75 GHz to the conventionally available frequencies 800 MHz and 2 GHz. In addition, this embodiment selects 2 GHz having a smaller difference from targeted 1.75 GHz, and thus chooses the pair of the second and third antenna element parts 270 and 280.

As shown in FIGS. 2, 4A and 5A, the fixture part 290 has a screw hole 292, into which a screw 294 (FIG. 7B) is inserted to fix the antenna 200 onto the cellular phone or radio movable communication apparatus 100. The fixture part 290 serves as the feeding point FP, and is made of a metallic material, such as copper.

Figure 6B:
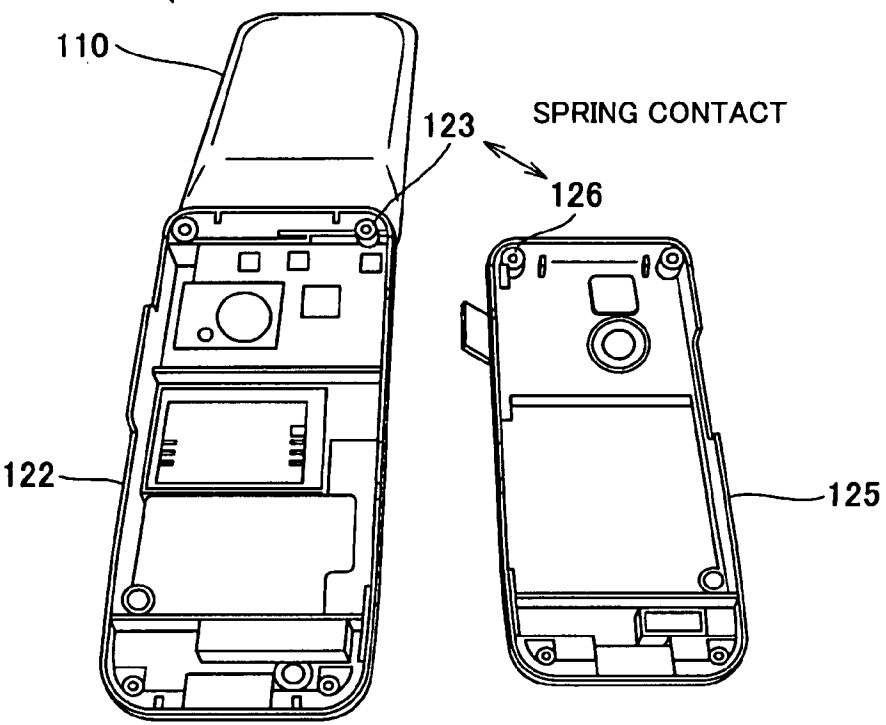
FIG. 6B is an exploded plane view of the cellular phone from which a rear case is removed.
Figure 6A:
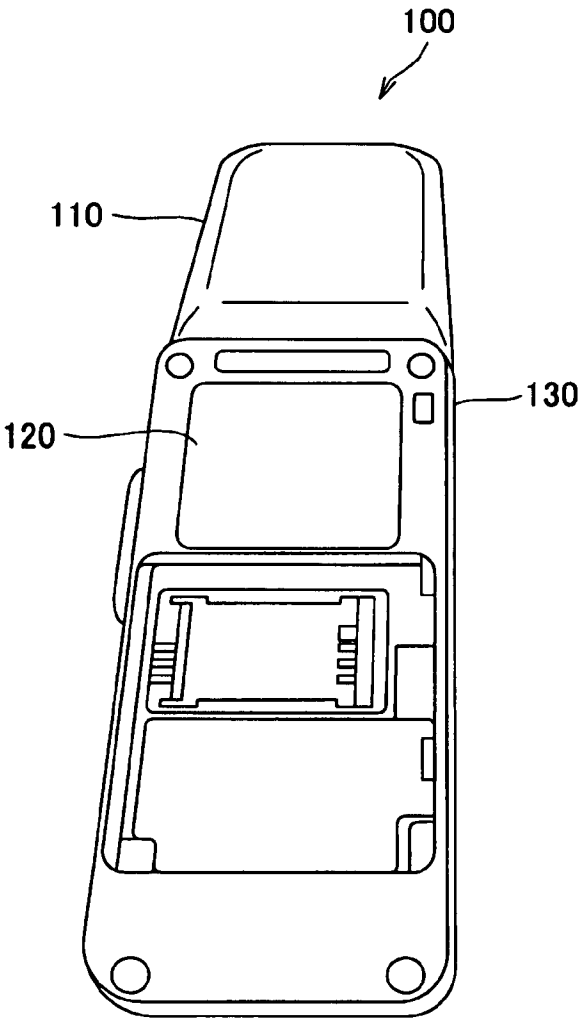
FIG. 6A is a rear view of a cellular phone as one example of the inventive wireless apparatus.

Referring now to FIGS. 6A to 7C, a description will be given of an attachment of the antenna 200 to the cellular phone 100. Here, FIG. 6A is a rear view of the cellular phone 100. FIG. 6B is an exploded plane view of the cellular phone 100 from which a rear case 125 is removed. FIG. 6C is an enlarged exploded plane view of the rear case 125 and the antenna 200.

Figure 6C:
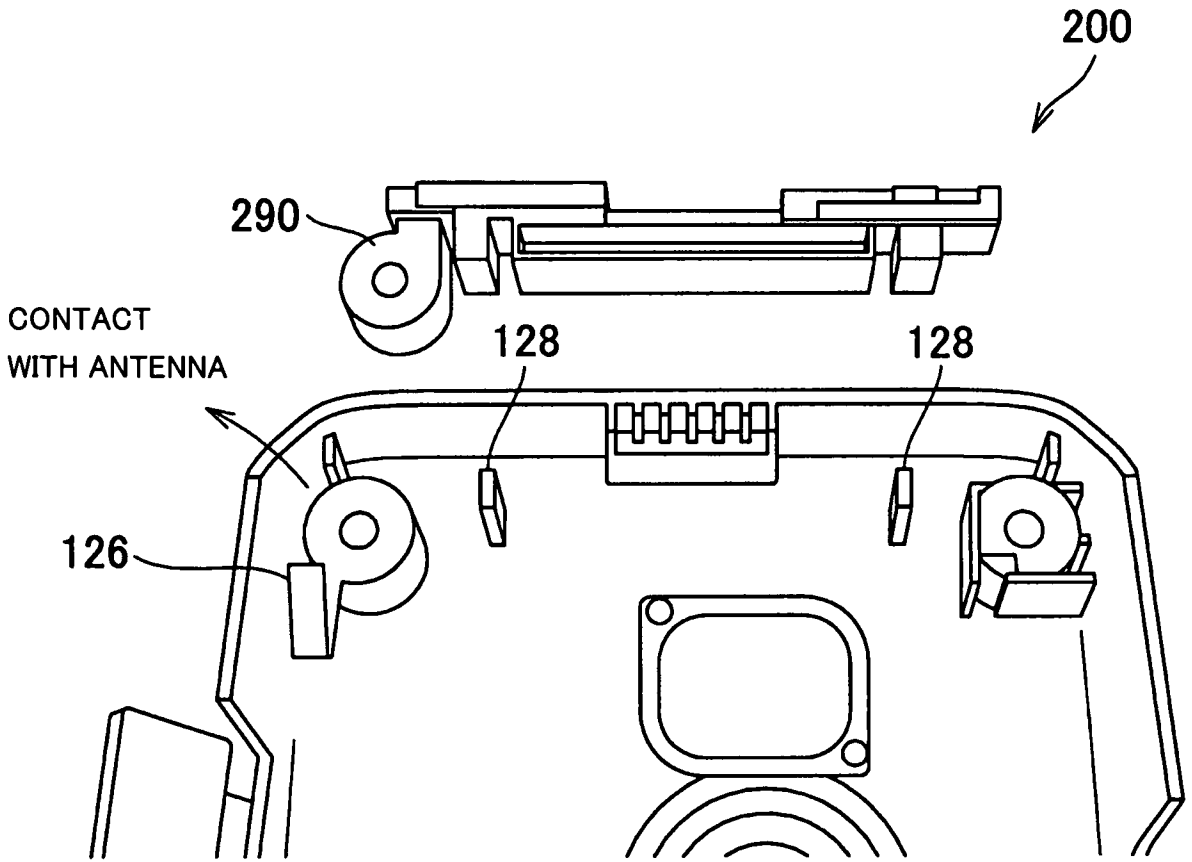
FIG. 6C is an enlarged exploded plane view of the rear case and the antenna.

The cell phone 100 is a foldable cellular phone that foldably couples a movable-side housing 110 to a fixed-side housing 120 via a hinge part 130. The movable-side housing 110 is configured to be rotatable relative to the fixed-side housing 120. The movable-side housing 110 has a housing structure that couples a front case to a rear case, installs a display, a receiver, a printed circuit board, etc. The fixed-side housing 120 also has a housing structure that couples a front case 122 to a rear case 125, and installs an operating part, a printed circuit board, a speaker, a vibrator, a camera, a battery, and the antenna 200. As shown in FIG. 6B, an antenna feeding point 123 that feeds the power to the fixture part 290 of the antenna 200 is formed on the front case 122. The rear case 125 includes, as shown in FIG. 6C, an antenna spring 126, and a pair of projections 128. The antenna spring 126 contacts the antenna feeding point 123, and the fixation point 290. The pair of projections 128 are engaged with the pair of engagement holes 222 in the base 220.

Figure 7A:
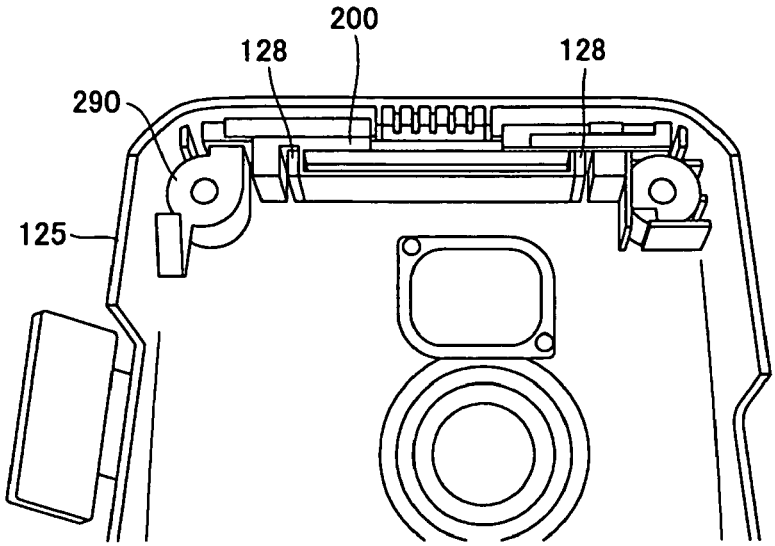
FIG. 7A is a partially enlarged perspective view showing that the antenna shown in FIG. 6C is attached to the rear case.
Figure 7B:
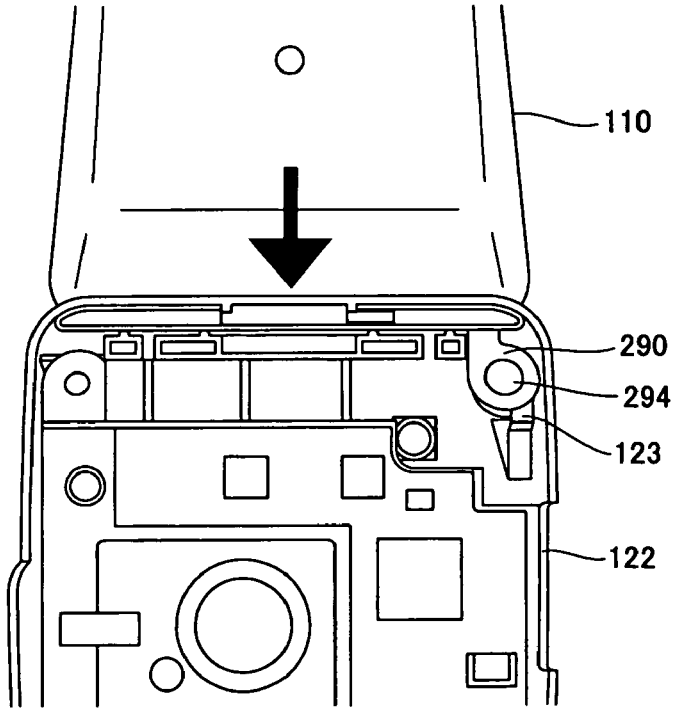
FIG. 7B is a partially enlarged plane view of a lower housing of the cellular phone shown in FIG. 6B.
Figure 7C:
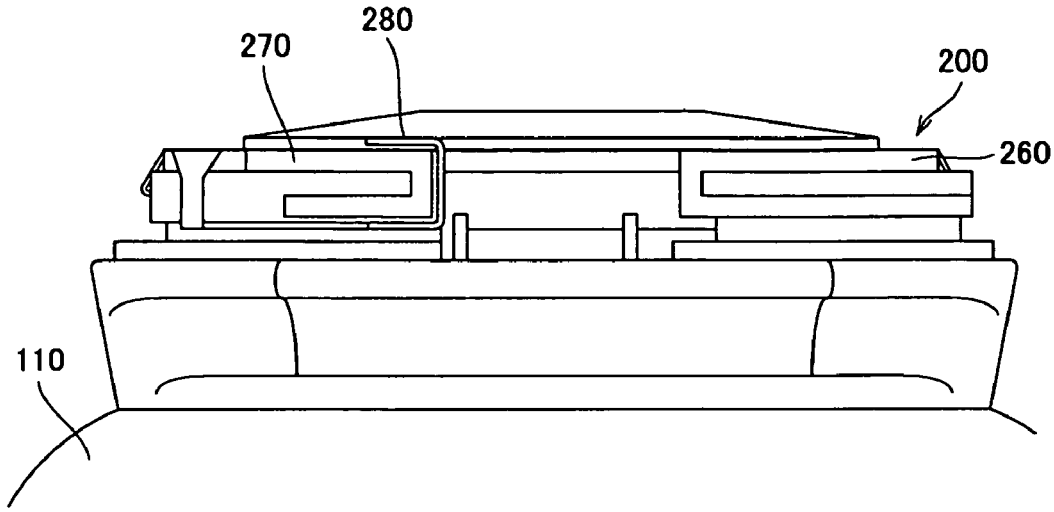
FIG. 7C is a partially enlarged FIG. 7B viewed from an arrow direction.

FIG. 7A is a partially enlarged perspective view showing that the antenna 200 shown in FIG. 6C is attached to the rear case 125. FIG. 7B is a partially enlarged plane view of the lower housing 120 shown in FIG. 6B. FIG. 7C is an enlarged FIG. 7B viewed from an arrow direction.

This embodiment can control the resonance frequency of the antenna 200, in attaching the antenna 200. In that case, this embodiment roughly determines the resonance frequencies by properly selecting the material of the dielectric, and the lengths of the antenna element parts. Next, this embodiment electromagnetically couples at least two of three antenna element parts to each other, and adjusts an interval between them for a fine adjustment of the target resonance frequency. Finally, this embodiment inserts the projections 128 into the engagement holes 222, fixes the antenna 200 onto the rear case 125 with the screws 294, and connects the antenna element 250 to the single feeding point FP.

In operation, the user uses the cellular phone 100, and enjoys communications through three resonance frequencies, while maintaining the cellular phone 100 small and lightweight. In addition, a fine adjustment of the targeted resonance frequency is easily available.

Further, the present invention is not limited to these preferred embodiments, and various variations and modifications may be made without departing from the scope of the present invention.

Thus, the present invention provides an antenna that maintains the miniaturization and provides three or more resonance frequencies, a control method of a resonance frequency using the same, and a wireless apparatus having the same.

What is claimed is:

1. An antenna that provides three resonance frequencies, said antenna comprising:

a dielectric; and an electrically conductive antenna element arranged on said dielectric, said antenna element branches into three parts configured to generate the three resonance frequencies and being connected to a single feeding point, and at least two of the three parts being electromagnetically coupled with each other so as to form one of the three resonance frequencies, wherein said antenna element has a solid structure by bending an electric conductor on said dielectric, and the three part includes:

a first part that extends in a first direction and has a Z shape;

a second part that extends in second direction opposite to the first direction; and a third part that extends in the second direction and then bends in a third direction perpendicular to the second direction, wherein the solid structure bends the first part in the second direction, bends the second part in the first direction, and bends the third part so as to enclose the second part that has been bent, and wherein the second part that has been bent is electromagnetically coupled with the third part that has been bent.

2. An antenna according to claim 1, wherein said at least two are arranged close to each other within an interval of 1 mm.

3. An antenna according to claim 1, wherein the solid structure bends one of said at least two, and bends the other so as to enclose the one.

4. An antenna according to claim 1, wherein the second part has a J shape.

5. An antenna according to claim 1, wherein the third part has an S shape.

6. A wireless apparatus comprising the antenna according to claim 1.

7. A wireless apparatus according to claim 6, wherein the wireless apparatus is a mobile radio communication apparatus.

* * * * *